United States Patent [19]

Wittry

[11] 4,165,472

[45] Aug. 21, 1979

[54] ROTATING ANODE X-RAY SOURCE AND COOLING TECHNIQUE THEREFOR

[75] Inventor: David B. Wittry, Pasadena, Calif.

[73] Assignee: Rockwell International Corporation, El Segundo, Calif.

[21] Appl. No.: 905,483

[22] Filed: May 12, 1978

[51] Int. Cl.[2] ..... H01J 35/10

[52] U.S. Cl. ..... 313/35; 313/30; 313/60; 313/330

[58] Field of Search ..... 313/60, 30, 34, 46, 313/330, 25, 35

[56] References Cited

U.S. PATENT DOCUMENTS 3,735,175 5/1973 Blomgren ..... 313/60

*Primary Examiner*—Rudolph V. Rolinec
*Assistant Examiner*—Darwin R. Hostetter
*Attorney, Agent, or Firm*—H. Fredrick Hamann; G. Donald Weber, Jr.

[57] ABSTRACT

A rotating anode x-ray source is disclosed having means by which to efficiently cool the electron beam target surface thereof. Energy is removed from the rotating anode target surface by a technique which includes liquid to vapor phase cooling.

22 Claims, 5 Drawing Figures

ROTATING ANODE X-RAY SOURCE AND COOLING TECHNIQUE THEREFOR

BACKGROUND OF THE INVENTION

1. Field of the Invention

This invention relates to an efficient technique for cooling the target of a rotating anode x-ray source.

2. Prior Art

High power x-ray tubes may be used in applications relating to x-ray difraction topography, fine line lithography, radiography, etc. One way to increase the brilliance or load per unit area of an x-ray tube is to continuously position the electron beam focus on a freshly cooled metal target face. A suitable technique for increasing brilliance is to select an x-ray tube having a movable (i.e. rotary) anode target and an induction motor to provide anode rotation. However, for an x-ray tube to undergo continuous operation, an efficient cooling technique must be incorporated therein, inasmuch as the average temperature of the target surface is proportional to the input power, and the allowable load of the rotating anode target is determined, in part, by the melting point of the electron beam metal target surface. Two essential features of a rotary anode design include a water circulating mechanism for cooling the electron beam target surface and a vacuum sealing mechanism.

Typically, a direct cooling technique is utilized in the prior art for cooling the rotating anode target surface with a stream of water. However, the prior art direct cooling technique requires coolant channels to be radially extended throughout the rotating anode target. This has the undesirable effect of increasing the hydrostatic pressure at the electron beam target surface. As a consequence of increased hydrostatic pressure, the anode target size is restricted and the input power and temperature are limited which, in turn, undesirably reduces output brilliance. Moreover, due to the prior art mechanism for feeding cooling water to the interior of the target, the circumferential velocity of the rotating anode target is limited. What is more, much of the cooling water is ultimately disposed of and wasted.

SUMMARY OF THE INVENTION

Briefly, and in general terms, a rotating anode x-ray source is disclosed having means to efficiently cool the electron beam target surface thereof by liquid to vapor phase cooling. In one embodiment of the invention, the rotating anode includes a cooled condensing surface and an adjacently disposed evacuated vapor cavity having a liquid reservoir formed therein. Heat that is applied to the rotating anode target surface causes the liquid in the cavity to vaporize. The vapor is condensed by the condensing surface and heat, in the form of vapor, is removed from the anode target surface via the condensing surface and a coolant carrying conduit. The resulting condensate is returned to the water reservoir by means of centrifugal force to complete a closed cooling cycle. In a preferred embodiment, the vapor cavity of the rotating anode comprises a wickless heat pipe.

In another embodiment of the invention, the anode target includes a wick means that is attached to one end of a hollow rotary shaft. The wick means is positioned adjacent the anode target surface. As part of an open cooling cycle, water is continuously supplied to the wick means via a channel that is formed through the anode. Heat that is applied to the anode target surface causes the water at the wick means to vaporize. The heat is carried away from the target surface by means of the vapor. This vapor passes through the hollow rotary shaft so as to drive a turbine which, in turn, provides rotation of the anode shaft.

DESCRIPTION OF THE PREFERRED EMBODIMENT

Figure 1:
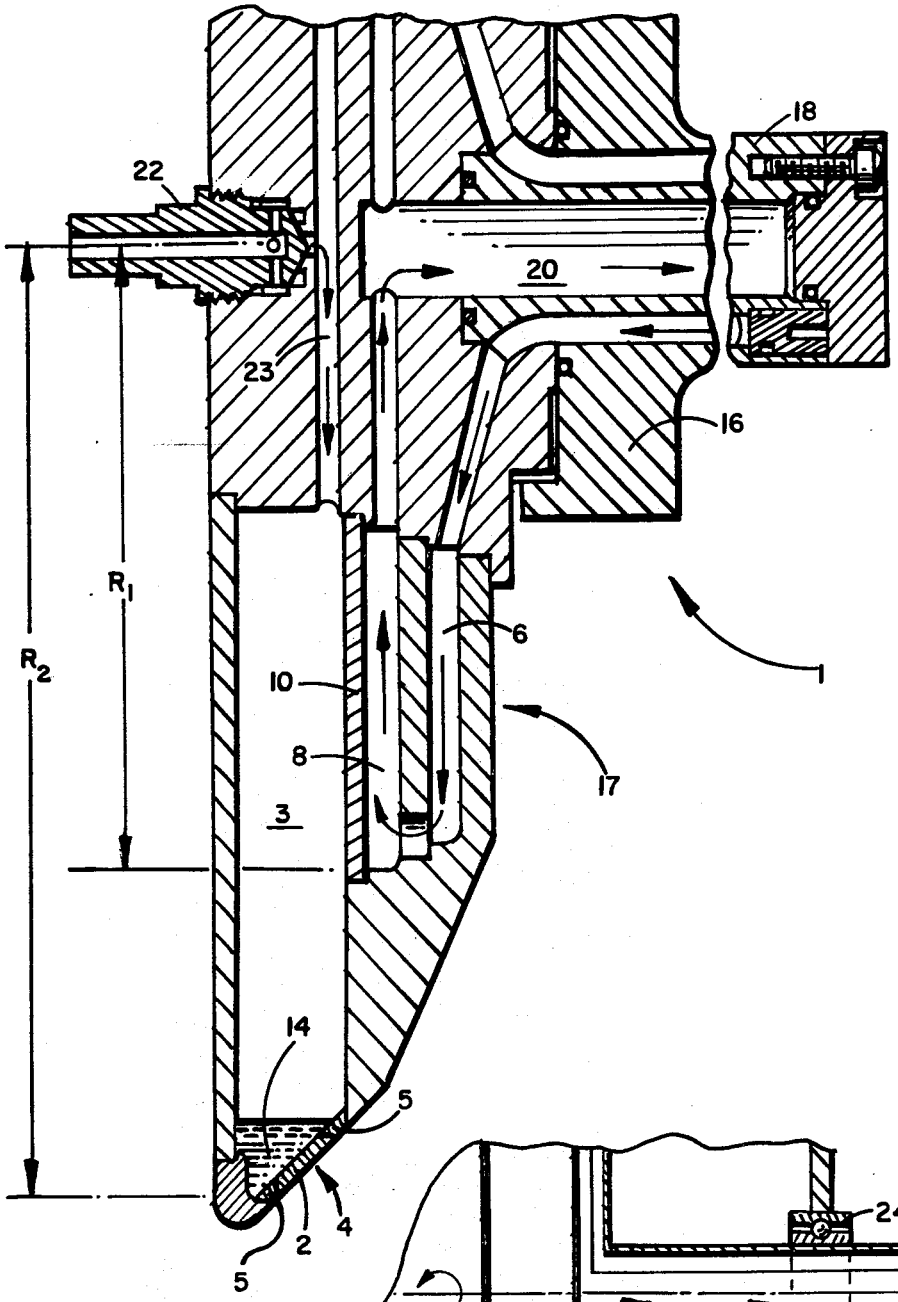
FIG. 1 shows a cross section of a rotating anode x-ray source which forms one embodiment of the present invention.

Referring to FIG. 1 of the drawings, a cross section of the rotating anode x-ray source 1, which forms a part of the present invention, is illustrated. The rotating anode 1 includes a hub member 16, a tapered disc or plate shaped member 17 and a spindle member 18. The rotating anode 1 has a cross section that is preferably fabricated from stainless steel. However, any other suitable material possessing the properties of high strength, low density and suitable corrosion resistance (such as, for example, aluminum, molybdenum, or magnesium) may also be used. In accordance with the instant invention, the rotating anode 1 is provided with unique cooling means by which to remove heat that is applied to the electron beam target surface 4, which target surface comprises a portion of the tapered front face of plate member 17. Coolant, such as water or the like, is circulated through the series connected inlet and outlet channels 6 and 8. The channels 6 and 8 form a continuous coolant path that extends both longitudinally through the anode rotary shaft 20 and radially from the centerline of shaft 20 through a portion of the anode plate member 17, the linear dimension of said radial extension being designated $R_1$. The coolant is supplied to and removed from the inlet and outlet channels 6 and 8 by means of suitable shaft seals (not shown) located on the shaft 20.

The rotating anode 1 includes a sealed, evacuated vapor chamber 3 that is formed within the plate member 17 opposite outlet channel 8. The evacuated vapor chamber 3 also extends radially from the center line of the anode shaft 20, the linear dimension of said radial extension being designated $R_2$. After the vapor chamber 3 is evacuated, a quantity of liquid, such as water or the like, is introduced therein via a plug 22 and an associated inlet channel 23 so as to, thereby, form a reservoir 14 in chamber 3, which reservoir is surrounded by adjacent rotating anode target surface 4.

The electron beam target surface 4 includes an electron beam target ring 2 that is formed from a material having a high thermal conductivity, such as copper, or the like. Nickel insert rings 5 are inserted between each of the top and bottom surfaces of the copper ring 2 and the stainless steel of the rotating anode 1 so that the copper ring 2 may be easily welded into a desirable position for providing a vacuum tight seal and enabling the target 4 to be bombarded with electrons.

A condensing surface 10, such as a plate or a ring, is assembled between the radially extending coolant outlet channel 8 and the evacuated vapor chamber 3. The condensing surface 10 is characteristically selected to have high strength and thermal transfer properties. Therefore, the condensing surface 10 may be fabricated from a material such as nickel, or the like.

As will be known to those skilled in the art, the hydrostatic pressure at the position where the coolant inlet channel 6 terminates and the coolant outlet channel 8 begins, is proportional to both the angular velocity $\omega$ and the radial dimension $R_1$ squared (i.e. $\omega^2R_1^2$), inasmuch as the mass of the coolant in the channels 6 and 8 is evenly distributed along the radial dimension $R_1$ as the anode rotates around the rotary shaft axis. However, the hydrostatic pressure that occurs at the tip of the rotating anode 1 (i.e. at the end of the target surface 4) is proportional to the angular velocity $\omega$ squared and to the radial dimension $R_2$ (i.e. $\omega^2R_2$), inasmuch as the reservoir 14 comprises substantially all of the mass along the dimension $R_2$ as the anode 1 rotates around the axis of the rotary shaft 20. As a result, and unlike prior art rotating anodes, the hydrostatic pressure at the anode target surface 4 increases linearly (rather than exponentially) as the radial dimension $R_2$ of the rotating anode plate member 17 is increased. Hence, the copper ring 2 may have a relatively thin cross section to thereby facilitate the removal of heat therefrom. Moreover, increased electron beam power and temperature can be handled by increasing either the diameter of the plate member 17 or the rate of rotation of the anode 1, without increasing the size of the condensing surface 10. Therefore, the limitations (e.g. reduced anode plate size and minimized target surface temperature) caused by excessive hydrostatic pressures at the direct water cooled rotating anodes of the prior art are substantially eliminated in the anode 1 of the present invention. What is more, in the case of an accidential rupture of the anode target surface 4 by an electron beam, only a very limited quantity of water will be leaked from the evacuated chamber 3.

Figure 2:
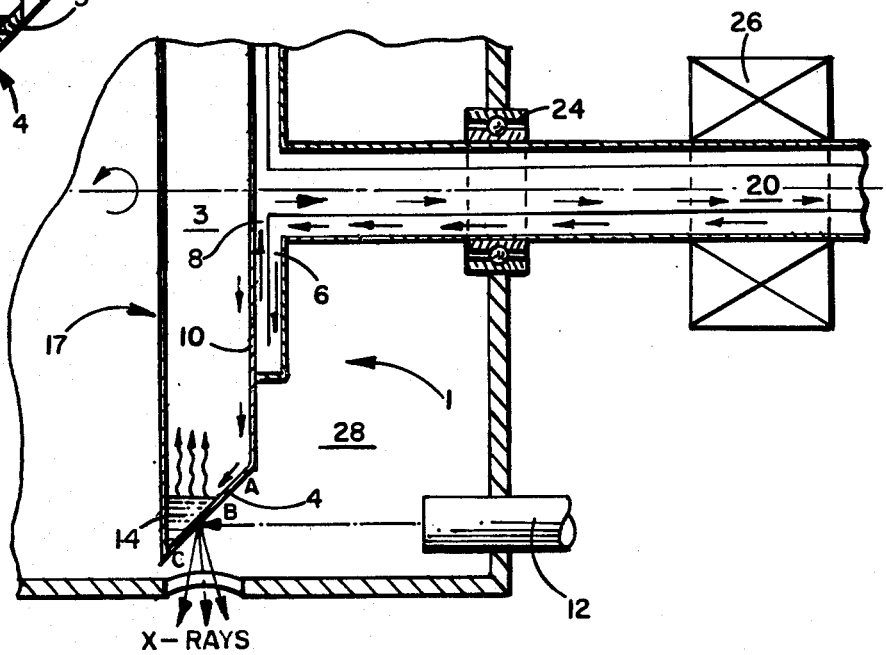
FIG. 2 is a schematic diagram of the rotating anode of FIG. 1, wherein the cooling technique therefor is described in detail.

Referring to FIG. 2 of the drawings, the rotating anode 1 is shown positioned within a vacuum chamber 28. A suitable rotary vacuum seal 24 (e.g. a ferro-fluidic seal) separates the shaft 20 of the rotating anode 1 from the walls of the vacuum chamber 28. The shaft 20 of the rotating anode 1 may be driven by any well known belt or direct drive motor 26. A suitable electron beam source 12 also extends through the walls of the vacuum chamber 28 and is aligned to bombard the anode target surface 4 with an electron beam. The resulting x-rays that are produced at the target surface 4 of the rotating anode 1 pass through a suitable x-ray window formed in the wall of the vacuum chamber 28.

The technique for optimizing the efficiency by which the rotating anode x-ray source 1 of FIG. 1 is cooled is described in detail while referring to FIG. 2. Heat is removed from the target surface 4 of the rotating anode 1 by the conversion of a liquid (e.g. water) to vapor. More particularly, water coolant that is circulated through the rotating anode shaft 20 via the inlet and outlet channels 6 and 8 flows past and cools the condensing surface 10. As previously disclosed in FIG. 1, the condensing surface 10 is assembled between the water coolant outlet channel 8 and the sealed, evacuated vapor chamber 3 of the rotating anode plate member 17. In operation, the heating action of an electron beam striking the rotating anode target surface 4, which surface surrounds the water reservoir 14, results in the generation of water vapor that is released into the evacuated vapor chamber 3. For example, if the condensing surface 10 is a ⅛ inch thick nickel ring and the temperature of the coolant that is circulated through the inlet and outlet channels 6 and 8 is 20° C., then the condensing surface 10 adjacent vapor chamber 3 may have a temperature of approximately 35° C. for operation at 6 KW power input. The water vapor present in the chamber 3 condenses on the cooled condensing surface 10, whereby the heat is conducted away from the target surface 4 via the condensing surface 10 and the coolant outlet channel 8. A resulting thin condensate film is pumped along condensing surface 10 by means of centrifugal force. It has been found that the hydrostatic pressure of the condensing surface 10 rotating at 5000 rpm is a relatively low 200 psi. The condensate is thereby returned to the water reservoir 14 in order to complete a closed cycle for cooling the target surface 4 of the rotating anode x-ray source 1.

As will be recognized by those skilled in the art, the evacuated vapor chamber 3 that is formed in the rotating anode plate member 17 comprises a wickless heat pipe, such as that known, for example, as a thermosyphon or reflux condenser. This heat pipe conducts heat away from the target surface 4 by means of liquid to vapor phase cooling, using centrifugal force to return the resulting condensate to the liquid reservoir.

The disclosed liquid to vapor phase cooling technique is substantially more efficient than the direct water cooling process common in the prior art, inasmuch as the conversion of water to vapor can absorb a large quantity of energy in the form of heat of vaporization. Moreover, the area available for removal of heat (i.e., the condensing surface) is many times larger than the area utilized in a direct water cooled system. By way of example, the area available for heat removal in a direct water cooling process is typically only two to three times larger than the area of the region bombarded with an electron beam. By way of further example, the electron beam generally produces a spot having a size in the order of about 1 mm. or less in diameter. What is more, the centrifugal pumping action of the rotating anode assembly 1 improves the transport of the condensate along the target surface 4 of the anode 1, so as to provide greater thermal transfer than if the assembly 1 were stationary.

The efficiency by which the rotating anode 1 is cooled may be controlled by regulating the position at which the electron beam strikes the target surface 4 thereof. By way of example, a first target position, designated A in FIG. 2, is located above the top of the reservoir 14. The thin film of condensate will evaporate as it is centrifugally pumped over the target surface 4 as that surface is heated by the presence of an electron beam. For a 6 KW electron beam and a 12 inch diameter anode rotating at 5000 rpm, the condensate film that is produced upon receipt of the beam at position A has been found to have a thickness of approximately 3 $\mu$m and a velocity of 99 cm/sec. If the heated target surface 4 has a length of approximately 3 mm, the condensate film will quickly traverse the surface 4 in approximately 3 milliseconds, so that complete evaporation of the film does not generally occur.

At a target position B, the electron beam strikes the target surface 4 just below the water level of the reservoir 14. This target position allows for greater availability of water and increased time for conversion of water to vapor. Since the vapor is formed near the top surface of the water reservoir 14, the vapor can easily escape into the evacuated chamber 3 of the anode 1.

At a target position C, the electron beam strikes the target surface 4 near the bottom of the reservoir 14. If the aforementioned 12 inch diameter anode rotates at 5000 rpm, the resulting centrifugal acceleration is approximately 4000 g's. The centrifugal acceleration creates a pressure differential of about six atmospheres between the top and bottom of the reservoir (e.g. that is approximately 1 cm. in height). Thus, the water at the bottom of the reservoir 14 does not immediately boil after being heated by the electron beam, but rises convectively towards the top surface thereof. However, when this heated water reaches a location at which the saturated vapor pressure for the corresponding temperature is equal to the hydrostatic pressure, the water begins to boil. The advantages of selecting target position C as the point of impact for the electron beam are that the water vapor production occurs over a substantially wider area (than that available by selecting either of target positions A or B) and the boiling of water promotes a vigorous stirring of the reservoir 14, thus further promoting an improved heat transfer. Nevertheless, the optimum position for the point of impact of the electron beam against the rotating anode target surface 4 can be determined by monitoring the temperature of a particular target surface impact point (e.g. with a spot focused pyrometer) just prior to the application of the electron beam thereto. This impact point on the target surface will undergo almost one complete revolution after its initial heating before it rotates back into position to be reheated under the electron beam, and it is, therefore, the coolest spot on the circumference of the front face of anode plate member 17.

Figure 3:
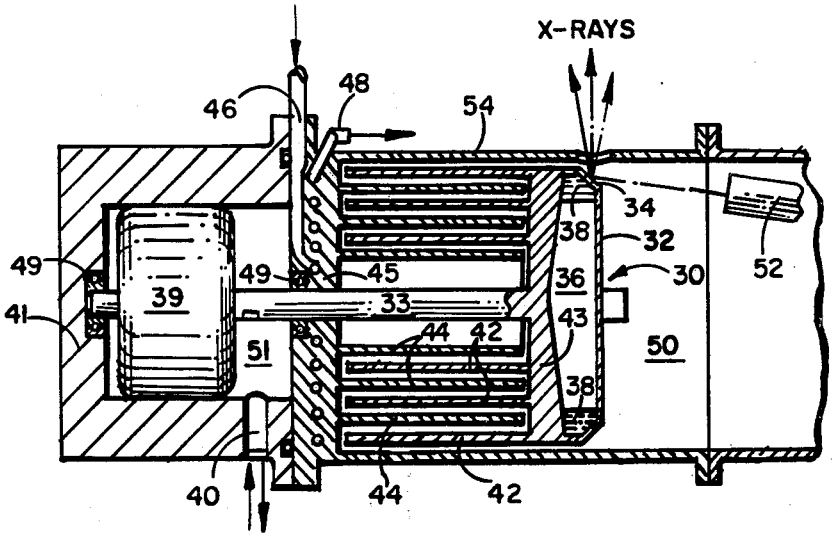
FIGS. 3 and 3*a* show the partial cross section of a rotating anode x-ray source and the cooling means therefor which form another embodiment of the present invention.

Referring to FIG. 3 of the drawings, another rotating anode x-ray source 30 is illustrated which incorporates a heat type principle whereby heat is removed from the anode target surface by conversion of water coolant to vapor. The technique utilized to cool the rotating anode 30 of FIG. 3 is similar to that shown by FIGS. 1 and 2, except, as will be disclosed in greater detail hereinafter, the rotating anode 30 utilizes a combination of radiation cooling as well as liquid to vapor phase cooling to remove heat from the electron beam target surface thereof. The rotating anode 30 includes a tapered disc or plate shaped member 32 and an elongated rotary shaft member 33 connected thereto. The electron beam target surface 34 comprises a portion of the front face of the plate member 32. Anode 30 includes a sealed, evacuated vapor chamber 36 formed within the plate member 32. The vapor chamber 36 is evacuated, and a quantity of liquid, such as water or the like, is thereafter introduced therein via an associated inlet plug (not shown). The water that is introduced into the chamber 36 forms a reservoir 38, which reservoir lies adjacent the rotating target surface 34. Rotation of the anode shaft 33 is provided by a suitable motor 39 such as, for example, a brushless d.c. motor. Motor 39 is connected to one end of the rotary shaft 33. An optical window 40 is formed in the wall 41 which encloses the motor 39. Optical window 40 is used to provide optical feedback to control the operation of motor 39 in a conventional fashion. The second end of rotary shaft 33 is connected to a planar rotating condensing surface 43. Condensing surface 43 is positioned adjacent vapor chamber 36 and forms a common terminus for a plurality of cylindrical rotating heat radiating fins 42 having a rectangular cross section. To maintain optimal thermal transfer characteristics, radiating fins 42 may be provided with an opaque (i.e. black) coating. Alternately and concentrically interspersed between the rotating fins 42 are a corresponding plurality of cylindrical stationary fins 44 also having a rectangular cross section. The stationary fins 44 are connected to a stationary water cooled plate 45. Thus, fins 42 and 44 extend in subtantial parallel alignment with shaft 33 and in opposing directions relative to one another from surfaces 43 and 45, respectively. Coolant inlet and outlet channels 46 and 48 provide a continuous path to circulate water, or the like, through the stationary plate 45 so as to remove heat that is supplied thereto. By way of example, water coolant having an initial temperature of 20° C. is supplied to the coolant inlet channel 46, while the water extracted from the outlet channel 48 typically has a temperature of approximately 40° C. The rotary shaft 33 is preferably separated from the motor wall 41 and the stationary plate 45 by means of suitable bearings 49.

The anode plate member 32, the rotary shaft 33, and the rotating and stationary fins 42 and 44 are all enclosed within a vacuum chamber 50. Moreover, the motor 39 may also be operated in a vacuum chamber 51 so that all rotary shaft seals are eliminated therefrom to enable high speed anode rotation. A suitable electron beam source 52 extends into the vacuum chamber 50 and is aligned to bombard the anode target surface 34 with an electron beam. The resulting x-rays that are produced at the target surface 34 pass through a suitable x-ray window formed in the walls 54 of the vacuum chamber 50.

The technique for optimizing the efficiency by which the rotating anode x-ray source 30 of FIG. 3 is cooled is described as follows. Like the rotating anode of FIGS. 1 and 2, heat is removed from the target surface 32 of the rotating anode 30 by the conversion of a liquid (e.g. water) to vapor. In operation, the heating action of an electron beam striking the rotating anode target surface 34, which surface surrounds the water reservoir 38, results in the generation of water vapor that is released into the evacuated vapor chamber 36. The water vapor present in the chamber 36 condenses on the rear surface of the plate member 32 that lies adjacent the condensing surface 43, whereby heat (in the form of vapor) is conducted away from the target surface 34 via the condensing surface 43 and the rotating fins 42. The heat is transferred from the rotating fins 42 to the stationary fins 44 by means of thermal radiation. The heat of the stationary fins 44 is conducted to the stationary plate 45 and removed therefrom via the coolant outlet channel 48. A resulting thin condensate film within chamber 36 is pumped along the inner rear face of the rotating anode plate member 32 by means of centrifugal force. The condensate is thereby returned to the reservoir 38 in order to complete a closed cycle for cooling the target surface 34 of the rotating anode x-ray source 30.

As will be recognized by those skilled in the art, the evacuated chamber 36 that is formed in the rotating anode plate member 32 comprises a wickless heat pipe. This heat pipe is similar to that illustrated in FIGS. 1 and 2 in that heat is conducted away from the target surface 34 by means of liquid to vapor phase cooling, while centrifugal force returns the resulting condensate to the fluid reservoir. However, thermal radiation (rather than direct thermal conduction) occurs between the rotating and the stationary fins 42 and 44 in order to ultimately transfer heat from the condensing surface 43 to the water cooled plate 45. What is more, by virtue of the vacuum chamber 50 enclosing rotary shaft 33 and fins 42 and 44, chamber 50 can be substantially devoid of vacuum seals, inasmuch as no water coolant is supplied therein.

Figure 3A:
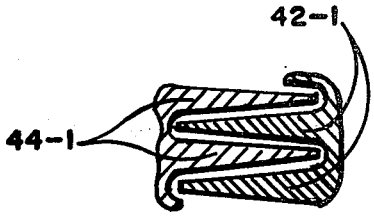

FIG. 3*a* shows an alternate fin configuration for the rotating and stationary fins 42 and 44 of the rotating anode 30 of FIG. 3. More particularly, rather than a rectangular fin cross section, the interspersed, cylindrial rotating and stationary anode fins 42-1 and 44-1 of FIG. 3*a* may have a rounded and tapered finger-like cross section, as shown, in order to maximize heat transfer therebetween.

Figure 4:
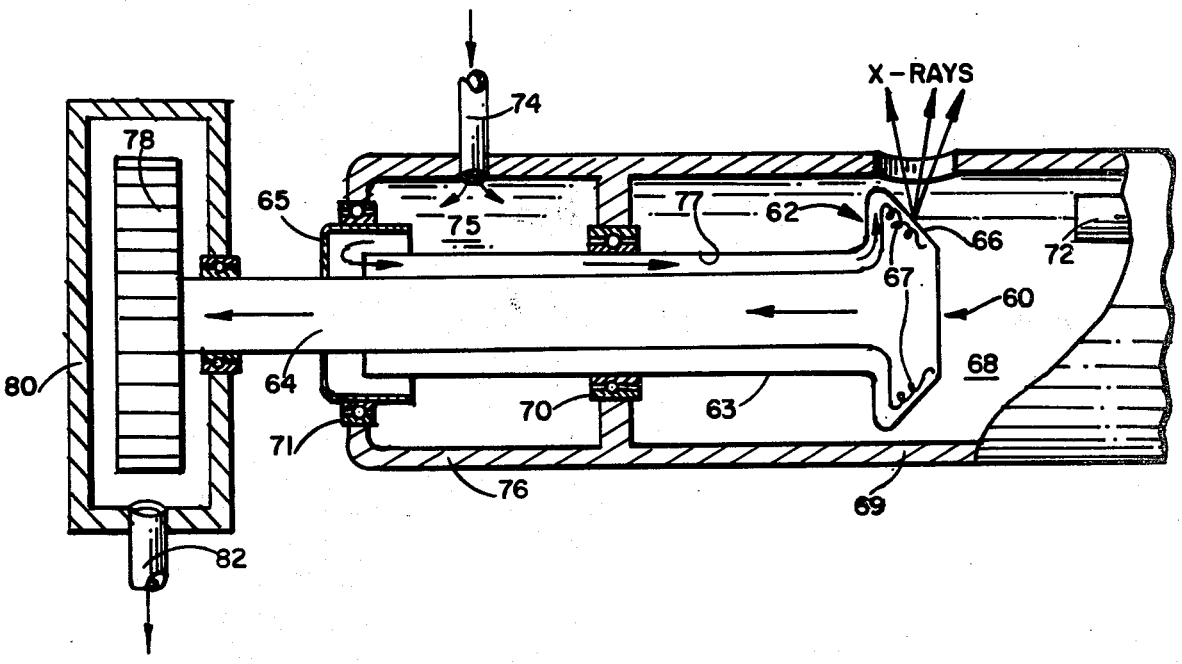
FIG. 4 shows a partial cross section of a rotating anode x-ray source and the cooling means therefor which form yet another embodiment of the present invention.

Referring to FIG. 4, of the drawings, another embodiment of a rotating anode x-ray source 60 and the cooling means therefor are illustrated. The rotating anode 60 comprises a tapered disc or plate shaped member 62, a longitudinally extending cylindrical outer anode wall 63 connected to plate member 62, and a hollow central rotary shaft 64 having an associated hub member 65. The anode 60 also includes an electron beam target surface 66, which surface comprises a portion of the front face of the plate member 62. A suitable wick means 67 is attached to a first end of the rotary shaft 64 and is positioned adjacent the target surface 66. The anode plate member 62 is positioned within a vacuum chamber 68. Vacuum chamber walls 69 surround the plate member 62 so as to prevent ambient contamination from affecting the anode operation. The vacuum chamber walls 69 are separated from the outer anode wall 63 by means of a suitable rotary vacuum seal 70. An electron beam source 72 extends into the vacuum chamber 68 and is aligned to bombard the anode target surface 66 with an electron beam. The resulting x-rays that are produced at the target surface 66 pass through a suitable x-ray window formed in vacuum chamber wall 69.

A coolant inlet conduit 74 extends into a coolant chamber 75, which chamber surrounds the second end of shaft 64 and is located adjacent vacuum chamber 68. The walls 76 of the coolant chamber 75 are separated from the shaft hub 65 by means of a suitable rotary water seal 71. As will be disclosed in greater detail hereinafter, the inlet conduit 74 introduces a supply of coolant into chamber 75 for application to the anode wick means 67 by means os capillary action. The second end of the rotary shaft 64 is extended through the coolant chamber 75 and is connected to a suitable bladed gas turbine 78. The turbine 78 is enclosed by a turbine wall 80. The walls 69, 76, and 80 of the vacuum chamber 68, the coolant chamber 75 and the turbine 78, respectively, are preferably fabricated from a strong corrosion resistant material such as stainless steel, or the like. An exhaust conduit 82 extends through turbine wall 80 to direct exhaust away from turbine 78.

The technique for cooling the target surface 66 of the rotating anode x-ray source 60 of FIG. 4 is described as follows. A liquid coolant, such as water, or the like, is introduced into the coolant chamber 75 by means of inlet conduit 74. The coolant cools the water seal 71. Moreover, the coolant flows through a channel 77 that is created between the central shaft 64 and the outer wall 63 of the rotating anode 60. The channel 77 is substantially narrowed to an orifice that is formed between the wick means 67 and the adjacent electron beam target surface 66. Therefore, the wick means 67 is adapted to plug the channel 75 and to change the size of the orifice to regulate the rate of coolant flow into the rotating anode 60.

The presence of an electron beam at the disc member 62 heats both the target surface 66 and the adjacently positioned wick means 67. As a result of the applied heat, the coolant begins to evaporate from the wick means 67. As the wick means 67 dries out, an increased supply of coolant is drawn through the channel 77 from the inlet conduit 74 by means of capillary action. It is to be understood, therefore, that when no heat is applied to the electron beam target surface 66, coolant flow through the anode 60 is substantially reduced, inasmuch as the wick means 67 blocks the orifice of channel 77. The heat that is applied to the electron beam target surface 66 converts the coolant in the orifice of channel 77 into vapor. The conversion of liquid coolant to vapor results in the absorption of a large quantity of energy in the form of latent heat of vaporization. Thus, the heat applied to the anode target surface 66 is removed therefrom in the form of vapor, and the rotating anode 60 is efficiently cooled. The vapor that is generated within the outer wall 63 of anode 60 is forced, by evaporation, through the hollow shaft 64 so as to be directed against the vanes of turbine 78. The turbine 78 is driven to provide rotation to the anode shaft 64. Turbine exhaust is removed by means of the exhaust conduit 82.

As will be understood by those skilled in the art, the present embodiment of the invention provides an open ended, self-regulating, rotating anode cooling system. That is, the more heat that is developed at the electron beam target surface 66, the larger the quantity of coolant that is converted to vapor, and, accordingly, the faster the turbine 78 drives the anode shaft 64.

It will be apparent that while a preferred embodiment of the invention has been shown and described, various modifications and changes may be made without departing from the true spirit and scope of the invention.

Having thus set forth a preferred embodiment of the instant invention, what is claimed is:

1. A rotating anode x-ray source and a cooling apparatus therefor, said rotating anode comprising:

anode plate means having an electron beam target surface, shaft means connected to said anode plate means to provide rotation thereto, cooling channel means formed in said anode plate means and extending therein in a radial direction from said shaft means, chamber means formed in said anode plate means, said chamber means containing a liquid reservoir therein, and condensing surface means assembled between said cooling channel means and said chamber means and adapted to be cooled by said cooling channel means, the chamber means liquid reservoir being heated when an electron beam strikes said anode plate means target surface so as to thereby release vapor into said chamber means, whereby said cooled condensing surface means causes the vapor to condense thereon, the condensate being centrifugally pumped back to the reservoir as the anode rotates, and the heat that is applied to said anode plate means target surface being removed therefrom via said condensing surface means and said cooling channel means.

2. The rotating anode recited in claim 1, wherein said chamber means is a sealed vapor cavity from which air is removed.

3. The rotating anode recited in claim 1, wherein said chamber means comprises a heat pipe, whereby heat that is applied to the anode plate means electron beam target surface is removed therefrom by liquid to vapor phase cooling, the vapor condensate formed on said condensing surface means being returned to the liquid reservoir by means of centrifugal force.

4. The rotating anode recited in claim 1, wherein the liquid reservoir of said chamber means is located adjacent said anode plate means electron beam target surface.

5. The rotating anode recited in claim 1, wherein said anode plate means includes a liquid valve having an associated liquid conduit, said liquid conduit connecting said valve to said chamber means, whereby liquid is added into said chamber means to form the reservoir thereof.

6. The rotating anode recited in claim 1, wherein said chamber means extends in said anode plate means in a radial direction from said shaft means, the radial extension of said chamber means in said anode plate means being longer than the corresponding radial extension of cooling channel means in said anode plate means.

7. The rotating anode recited in claim 1, wherein said condensing surface means is fabricated from nickel.

8. A rotating anode x-ray source and a cooling apparatus therefor, said rotating anode comprising:

target means having an electron beam target surface thereof, said target means including a heat pipe having a supply of liquid therein, shaft means connected to said target means to provide rotation thereto, condensing surface means assembled adjacent said target means, and means to cool said condensing surface means, whereby heat that is applied to the electron beam target surface of said target means is removed therefrom by the conversion of heat pipe liquid to vapor, so that vapor condensate is formed on the walls of the heat pipe to be returned to the heat pipe liquid supply by centrifugal force as said target means rotates, such that heat, in the form of vapor, is conducted away from the target surface via said condensing surface means and said means to cool said condensing surface means.

9. The rotating anode recited in claim 8, wherein said target means heat pipe comprises a vapor chamber from which air is removed.

10. The rotating anode recited in claim 8, further including cooling channel means extending radially through said target means and positioned adjacent said condensing surface means in order to cool said condensing surface means and to remove heat from said target means heat pipe.

11. The rotating anode recited in claim 8, wherein said condensing surface means has a first plurality of heat radiating fins attached thereto, said shaft means connected to said condensing surface means in order to provide rotation to said condensing surface means and to said heat radiating fins.

12. The rotating anode recited in claim 11, further including plate means having a second plurality of fins attached thereto, the second plurality of fins interspersed with the first plurality of fins, whereby heat is transferred from the first plurality of fins to the second plurality of fins by thermal radiation.

13. The rotating anode recited in claim 12, wherein said plate means includes a channel to circulate a coolant through said plate means, whereby heat that is radiated to the second plurality of fins is removed therefrom via said plate means and said coolant channel means by thermal conduction.

14. The rotating anode recited in claim 12, wherein said plate means and the second plurality of fins are maintained in a stationary position relative to the rotation of said condensing surface means and the first plurality of fins.

15. The rotating anode assembly recited in claim 12, further including drive means to rotate said shaft means, said drive means, said target means, said condensing surface means, said plate means, and the first and second pluralities of fins all enclosed in a vacuum.

16. The rotating anode assembly recited in claim 12, wherein each of said first and second pluralities of fins have a cylindrical configuration, said first and second pluralities of fins concentrically interspersed with one another.

17. A rotating anode x-ray source having an electron beam target surface and means by which to cool said target surface thereof, a supply of liquid within said anode and adjacent said target surface, whereby heat that is applied to said target surface causes the liquid in said anode to vaporize, and means by which to remove the heat of vaporization from said anode, so that said target surface thereof is cooled by means of converting the liquid into vapor.

18. The rotating anode recited in claim 17, wherein said anode includes a sealed heat pipe, said heat pipe containing the supply of liquid.

19. The rotating anode recited in claim 17, said rotating anode also including shaft means positioned within said anode and connected thereto so as to provide rotation to said target surface, said shaft means having a wick attached to one and thereof and positioned adjacent said target surface to form an orifice therebetween.

20. The rotating anode recited in claim 19, further including turbine means connected to the second end of said shaft means for driving said shaft means.

21. The rotating anode recited in claim 19, said rotating anode also including a liquid channel connected to a source of liquid and formed between said shaft means and said target means, said liquid channel means adapted to provide liquid to said wick means by means of capillary action, whereby heat applied to the target surface of said target means causes the liquid of said adjacent wick means to vaporize.

22. The rotating anode recited in claim 21, wherein said shaft means is hollow, the vapor formed at the target surface of said anode is removed therefrom via said hollow shaft means, whereby heat is removed from the target surface in the form of vapor.

* * * * *